US007434496B2

(12) United States Patent
Hu

(10) Patent No.: US 7,434,496 B2
(45) Date of Patent: Oct. 14, 2008

(54) SCREWDRIVER HANDLE

(76) Inventor: Bobby Hu, 8F, No.536-1, Ta Chin Street, Taichung (TW)

( * ) Notice: Subject to any disclaimer, the term of this patent is extended or adjusted under 35 U.S.C. 154(b) by 0 days.

(21) Appl. No.: 11/563,491

(22) Filed: Nov. 27, 2006

(65) Prior Publication Data

US 2008/0121074 A1 May 29, 2008

(51) Int. Cl.
*B25B 23/16* (2006.01)

(52) U.S. Cl. ..... 81/177.7; 81/177.8; 403/160

(58) Field of Classification Search ..... 81/177.7–177.9; 16/110.1, 900; 403/160, 96; D8/61–62
See application file for complete search history.

(56) References Cited

U.S. PATENT DOCUMENTS 2,630,114 A * 3/1953 Hart ..... 403/160
4,759,240 A * 7/1988 Lin ..... 81/177.8

* cited by examiner

*Primary Examiner*—D. S Meislin
(74) *Attorney, Agent, or Firm*—Alan Kamrth; Kamrath & Associates PA

(57) ABSTRACT

A screwdriver handle includes first and second handle parts each having an end face with a pivotal coupling portion. The second handle part is pivotable between two positions relative to the first handle part such that the screwdriver handle is switchable between an in-line state and an angled state. Two positioning holes are defined in one of the end faces and a receptacle is defined in the other end face and aligned with one of the positioning holes. A positioning member is mounted in the receptacle and includes an end releasably engaged with one of the positioning holes to retain the second handle part in one of the positions. A control member is mounted on one of the first and second handle parts and operable to disengage the positioning member from the positioning holes to thereby allow the second handle part to pivot relative to the first handle part.

5 Claims, 20 Drawing Sheets

3 - 3

SCREWDRIVER HANDLE

BACKGROUND OF THE INVENTION

1. Field of the Invention

The present invention relates to a screwdriver handle that can be retained in an in-line state or an angled state.

2. Description of the Related Art

FIGS. 1 through 4 of the accompanying drawings illustrate a conventional screwdriver handle 90 comprising a front handle part 91 and a rear handle part 92. In a first position, the longitudinal axes of the handle parts are substantially coincident with each other and in a second position, the longitudinal axes of the handle parts are at an angle relative to each other. The front handle part 91 includes a slanted circular rear end face 911. A pivotal member 912 is mounted to the rear end face 911 and includes a protrusion 913. A push button 914 and a spring 915 are mounted in a compartment (not labeled) in a side of the pivotal member 912, with an end of the push button 914 extending out of the front handle part 91 for manual operation via a through-hole (not labeled) in the front handle part 91. The rear handle part 92 includes a slanted circular front end face 921 in which a groove 922 is defined for pivotally receiving the pivotal member 912. A through-hole 923 extends from a bottom wall defining the groove 922 through an outer periphery of the rear handle part 92. A C-clip (not labeled) is mounted in the through-hole 923 for retaining the protrusion 913 in the through-hole 923 while allowing pivotal movement of the pivotal member 912. A plug 924 is provided to seal the through-hole 923. Three positioning holes 925 are defined in a circumferential wall defining the groove 922, and the other end of the push button 914 is selectively engaged in one of the positioning holes 925 for retaining the front handle part 91 in place.

However, in addition to the through-hole in the front handle part 91, it is necessary to drill another hole (i.e., the through-hole 923) in the second handle part and to provide a plug 924 for sealing the through-hole 923 required for mounting the C-clip onto the protrusion 913, which is time-consuming and costly. Further, the plug 924 is apt to fall out of the through-hole 923 during operation, leading to accumulation of dust and dirt in the through-hole 923 that may cause adverse effect to pivotal movement and/or positioning effect of the front handle part 91.

Further, the push button 914 of the screwdriver handle in the second position is located in a position other than that in the first position; namely, the push button 914 in the second position must be pressed in a direction different from that required in the first position, leading to inconvenient operation.

SUMMARY OF THE INVENTION

A screwdriver handle in accordance with the present invention comprises a first handle part and a second handle part. Each of the first and second handle parts includes an end face. A first pivotal coupling portion is formed on one of the end faces of the first and second handle parts. A second pivotal coupling portion is formed on the other of the end faces of the first and second handle parts. The second pivotal coupling portion is pivotally engaged with the first pivotal coupling portion. The second handle part is pivotable between a first position and a second position relative to the first handle part such that the screwdriver handle is switchable between an in-line state and an angled state.

Two positioning holes are defined in one of the end faces of the first and second handle parts. A receptacle is defined in the other of the end faces of the first and second handle parts. The receptacle is aligned with one of the positioning holes in association with the in-line state and the angle state of the screwdriver handle. A positioning member is mounted in the receptacle and includes an end releasably engaged with one of the positioning holes to retain the second handle part in one of the first position and the second position. The screwdriver handle further having the end of the positioning member biased to engage with one of the positioning holes. A control member is mounted on one of the first and second handle parts and connected to the positioning member. The control member is operable to disengage the end of the positioning member from the positioning holes to thereby allow the second handle part to pivot relative to the first handle part.

Preferably, the end faces of the first and second handle parts are slanted.

Preferably, the end faces of the first and second handle parts are oval.

Preferably, the positioning holes are located on a longitudinal axis of one of the end faces of the first and second handle parts.

In an example, the first pivotal coupling portion is an axle on the first handle part and the second coupling portion is a groove in the second handle part.

In another example, the first pivotal coupling portion is a groove in the first handle part and the second coupling portion is an axle on the second handle part.

Preferably, one of the first and second handle parts on which the control member is mounted includes a slot that is in communication with the receptacle. The control member includes an engaging portion extending through the slot to securely engage with the positioning member.

Other objectives, advantages, and novel features of the invention will become more apparent from the following detailed description when taken in conjunction with the accompanying drawings.

DETAILED DESCRIPTION OF THE PREFERRED EMBODIMENTS

Figure 1:
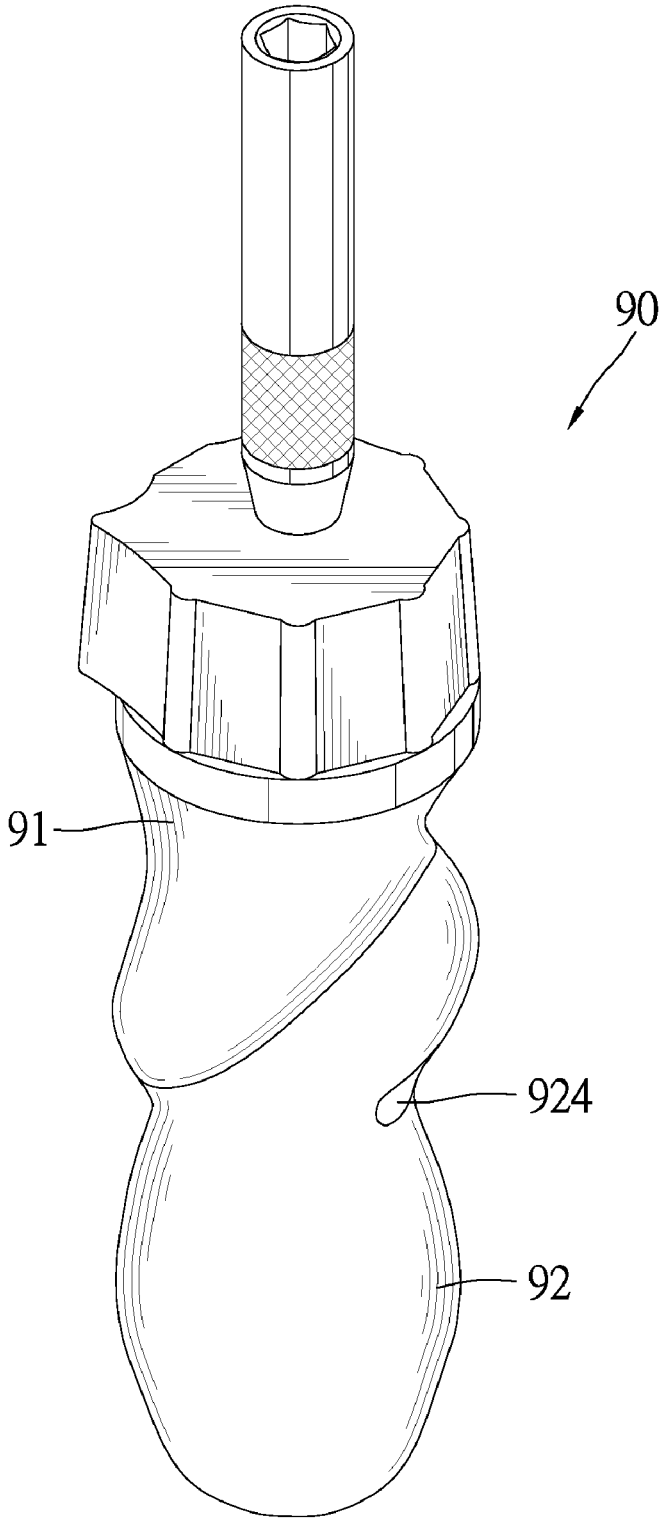
Fig. 1 PRIOR ART
FIG. 1 is a perspective view of a conventional screwdriver handle.
Figure 2:
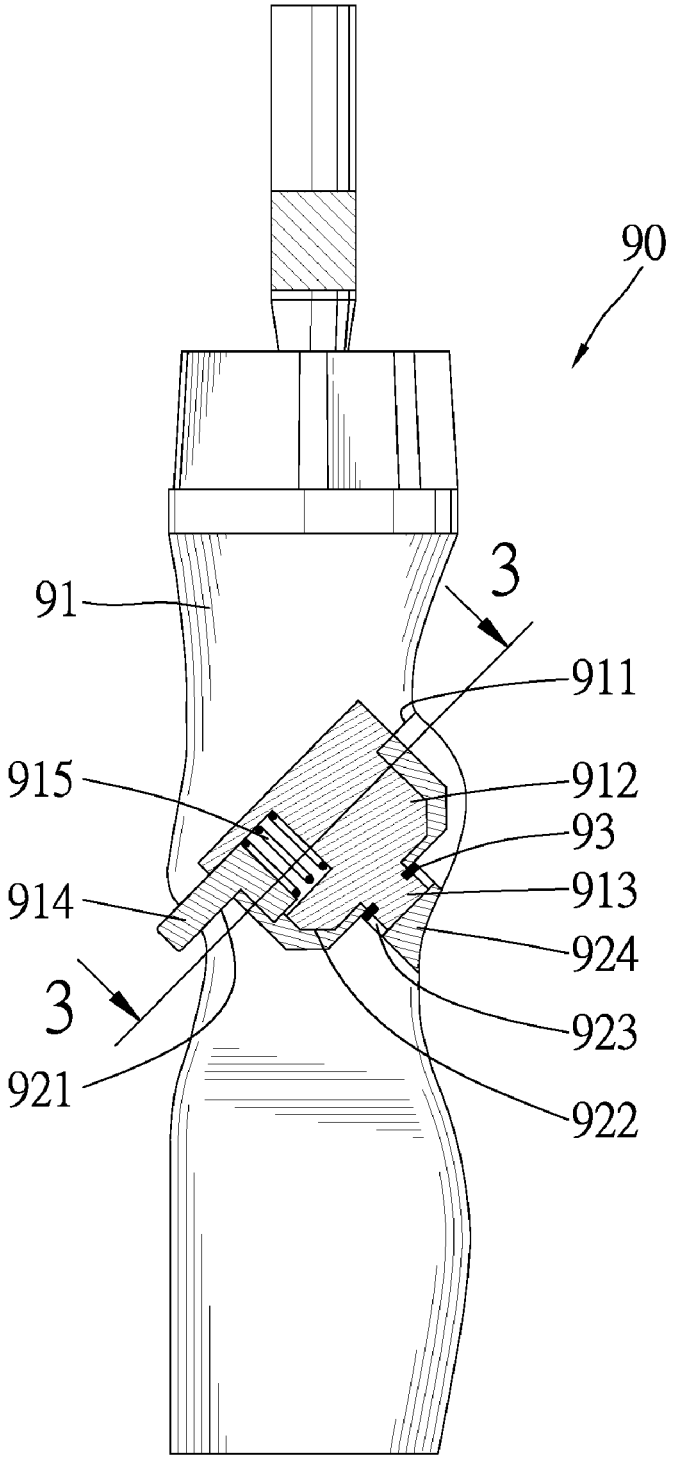
Fig. 2 PRIOR ART
FIG. 2 is a sectional view of the screwdriver handle in FIG. 1.
Figure 3:
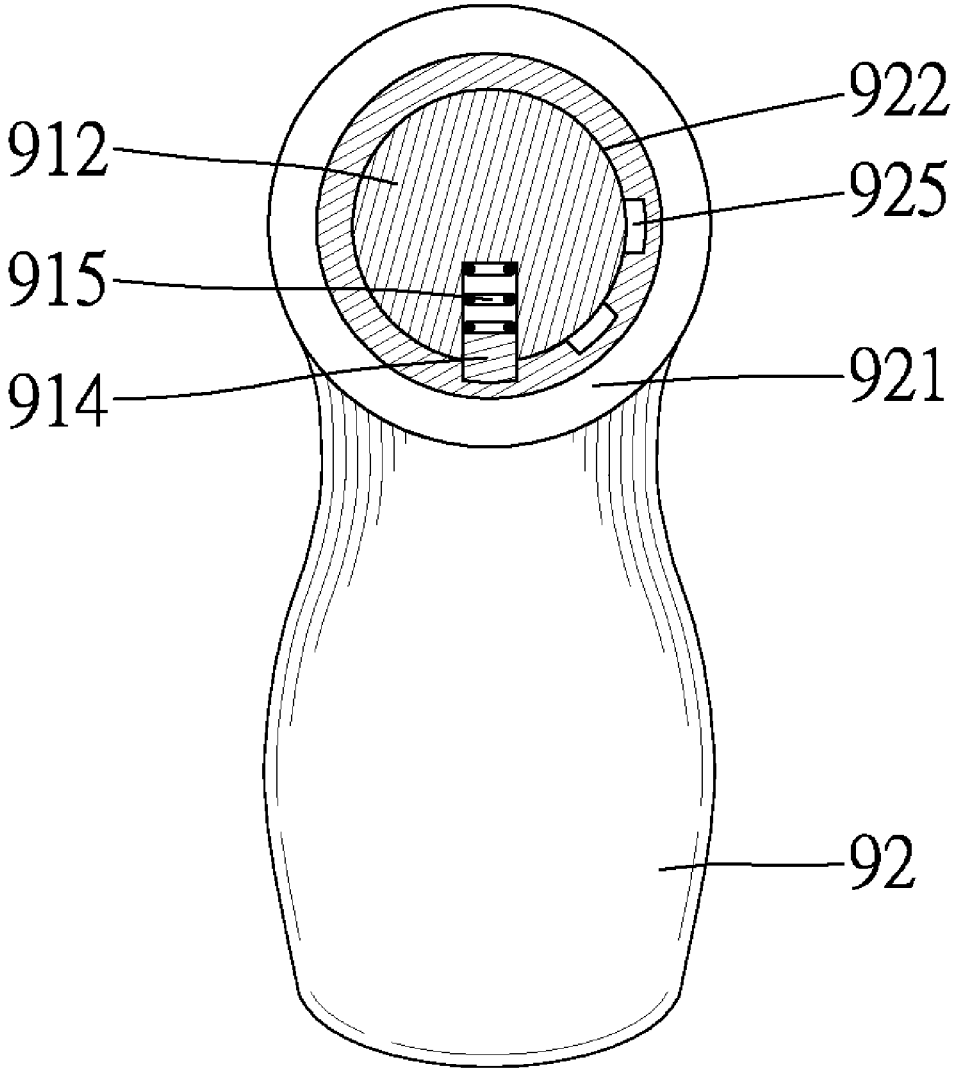
Fig. 3 PRIOR ART
FIG. 3 is a sectional view taken along plane 3-3 in FIG. 2.
Figure 4:
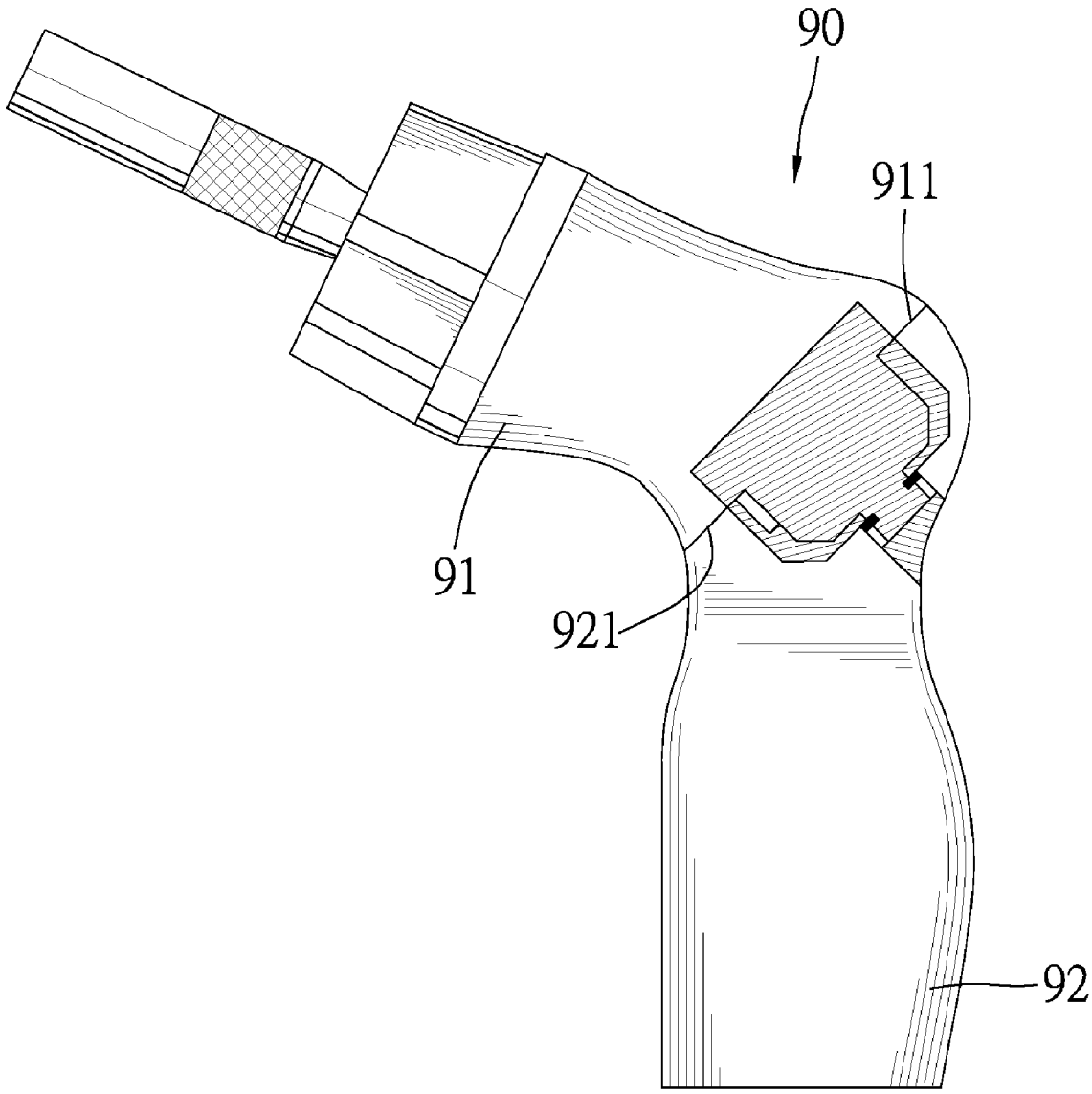
Fig. 4 PRIOR ART
FIG. 4 is another sectional view of the screwdriver handle in FIG. 1, wherein the screwdriver handle is in an angled state.
Figure 5:
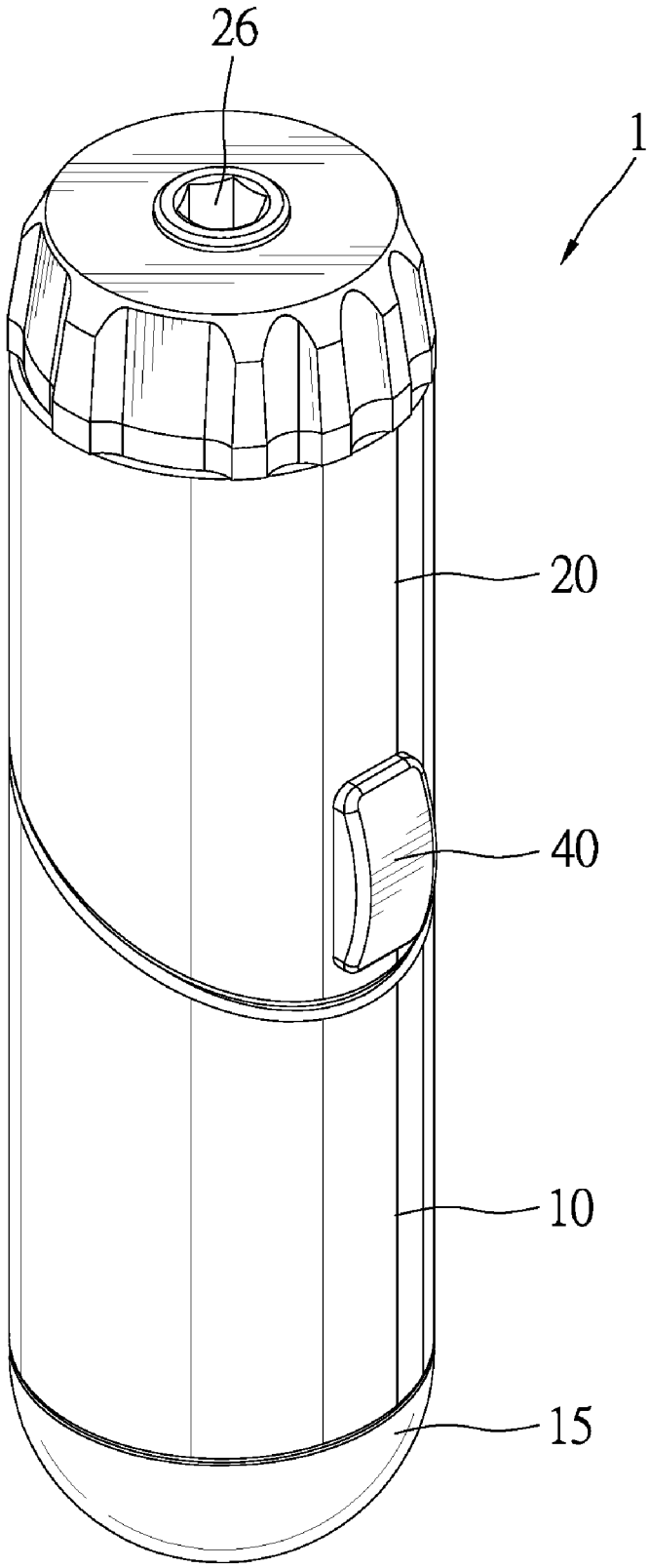
FIG. 5 is a perspective view of an embodiment of a screwdriver handle in accordance with the present invention.
Figure 6:
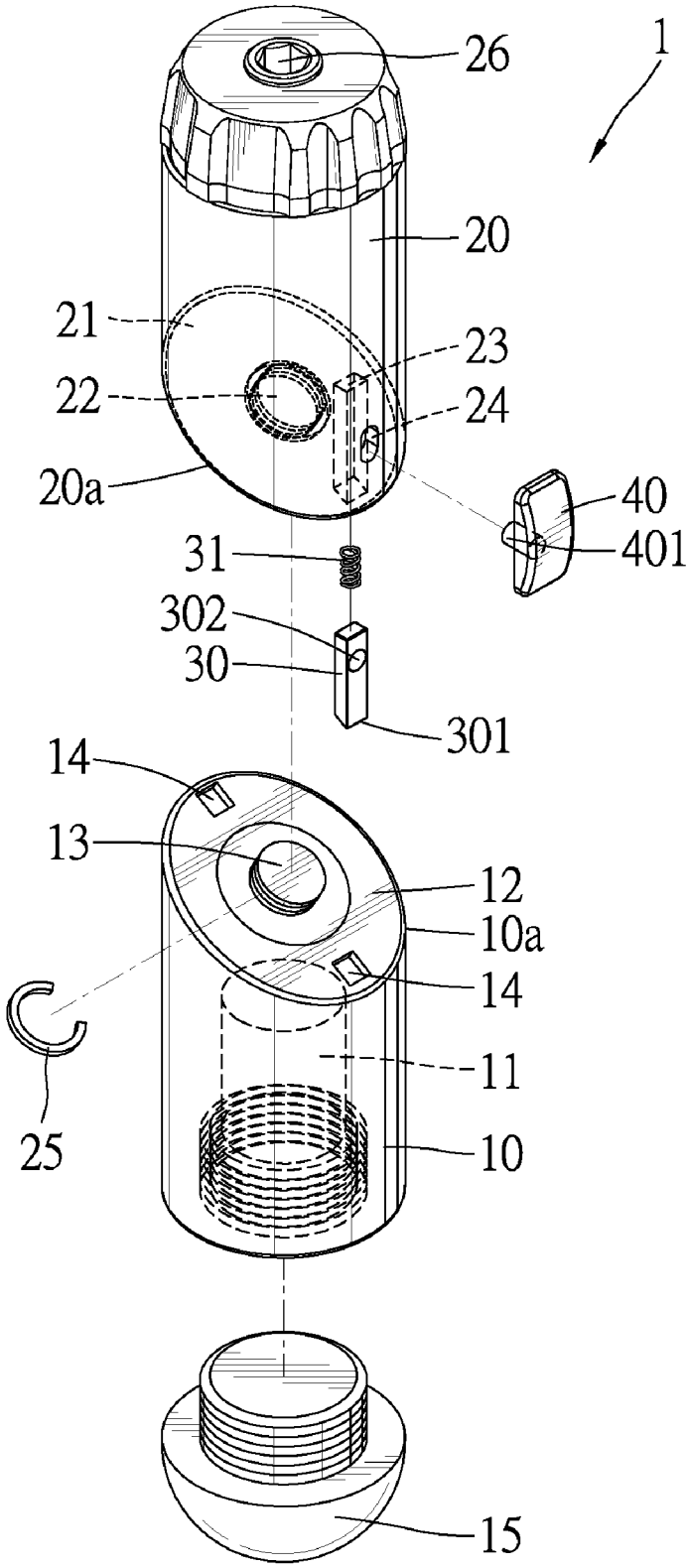
FIG. 6 is an exploded perspective view of the screwdriver handle in FIG. 5.
Figure 7:
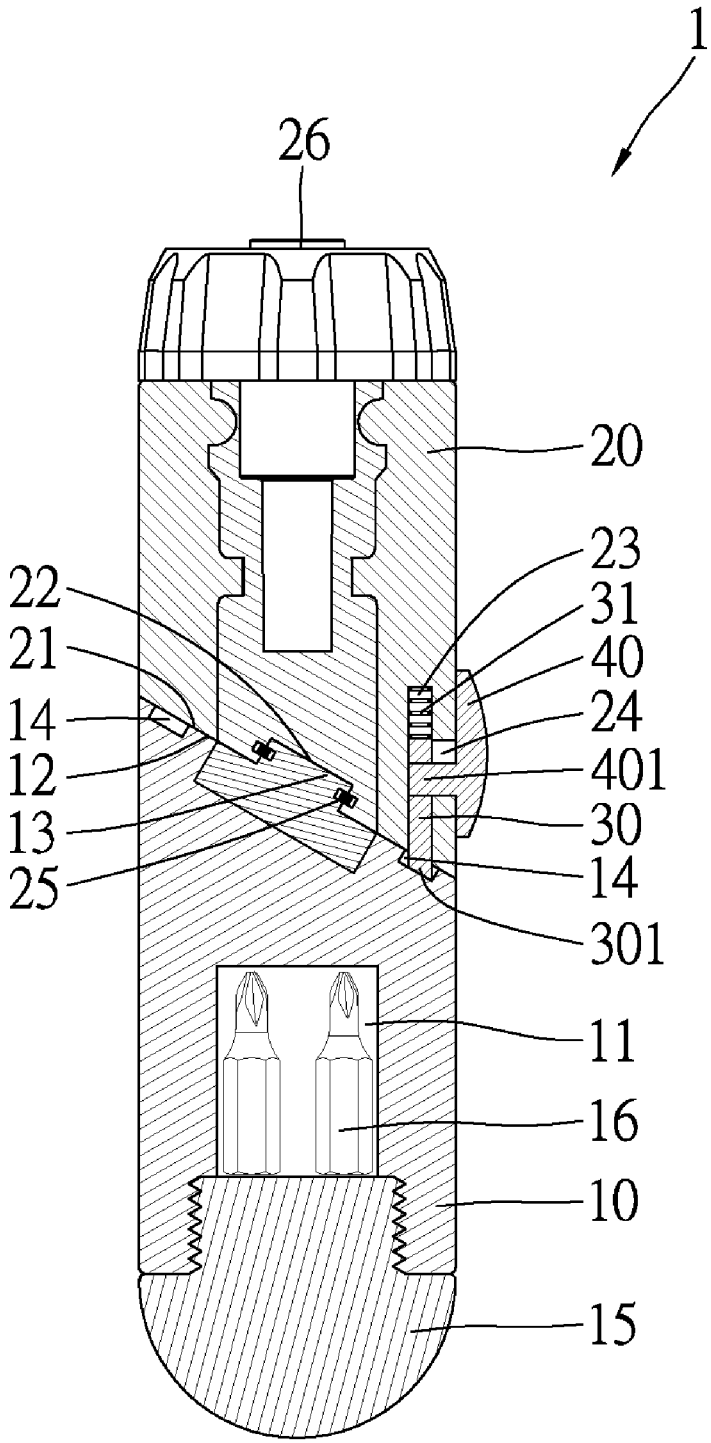
FIG. 7 is a sectional view of the screwdriver handle in FIG. 5.

Referring to FIGS. 5 through 7, an embodiment of a screwdriver handle 1 in accordance with the present invention comprises a first handle part 10, a second handle part 20, a positioning member 30, and a control member 40. An end of the second handle part 20 is pivotally connected to an end of the first handle part 10 and retained in place by the positioning member 30.

The first handle part 10 includes a first end and a second end. A compartment 11 is defined in the first end of the first handle part 10 for receiving a plurality of bits 16, and an end cap 15 is provided to seal the compartment 11. The second end of the first handle part 10 includes a slanted connecting portion 10*a*. The slanted connecting portion 10*a* of the first handle part 10 includes a non-circular (oval in this example) end face 12. Preferably, the end face 12 is slanted. Namely, the end face 12 extends in a plane at an acute angle with a longitudinal axis of the first handle part 10. A pivotal coupling portion (an axle 13 in this example) is formed on the end face 12 and is preferably cylindrical. Two positioning holes 14 are defined in the end face 12. Preferably, the positioning holes 14 are located on the longitudinal axis of the end face 12.

The second handle part 20 includes a first end and a second end. The first end of the second handle part 20 includes a coupling portion 26 for coupling with a bit (not shown) or the like. The coupling portion 26 may include a ratchet mechanism (not shown). A connecting portion 20*a* is formed on the second end of the second handle part 20 and includes a non-circular (oval in this example) end face 21. Preferably, the end face 21 is slanted. Namely, the end face 21 extends in a plane at an acute angle with a longitudinal axis of the second handle part 20. The end face 12 of the first handle part 10 and the end face 21 of the second handle part 20 are symmetric relative to the longitudinal axis of the end face 21 of the second handle part 20 that is coincident with (or parallel to) that of the end face 12 of the first handle part 10.

A pivotal coupling portion (a cylindrical axle receiving groove 22 in this example) is formed on the end face 21 of the second handle part 20 for pivotally receiving the axle 13 of the first handle part 10, allowing relative pivotal movement between the first handle part 10 and the second handle part 20. In this example, a retainer ring 25 is partially engaged in an annular groove (not labeled) defined in a circumferential wall defining the axle receiving groove 22 and partially engaged in an annular groove (not labeled) in an outer circumferential wall of the axle 13.

Figure 9:
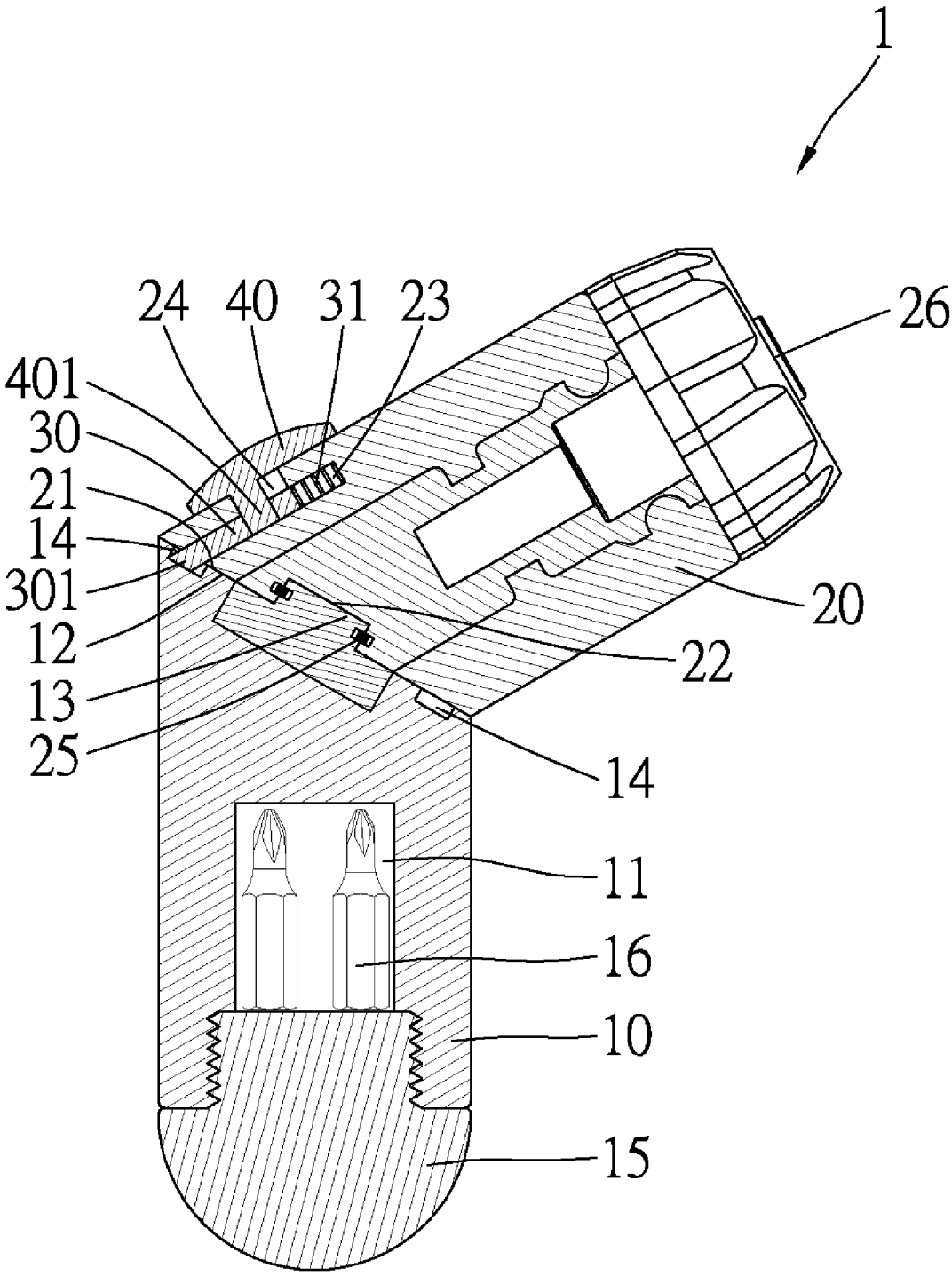
FIG. 9 is a sectional view of the screwdriver handle in FIG. 5 in an angled state.
Figure 10:
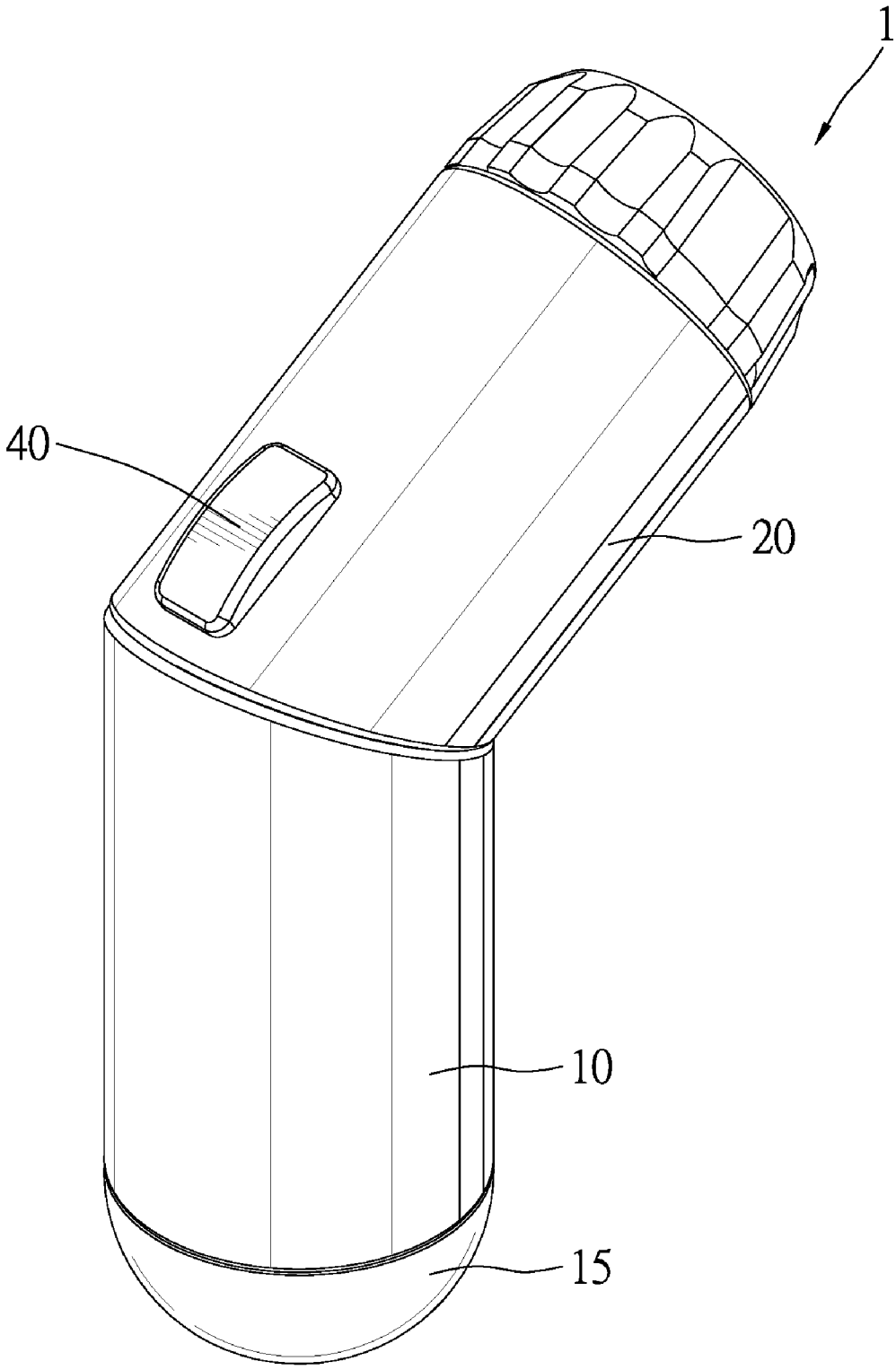
FIG. 10 is a perspective view of the screwdriver handle in FIG. 9.

The second end of the second handle part 20 is pivotally connected to the second end of the first handle part 10 and movable between a first position and a second position relative to the first handle part 10 such that the screwdriver handle 1 is switchable between an in-line operating state (see FIGS. 5 and 7) and an angled operating state (see FIGS. 9 and 10). When in the angled operating state in which the second handle part 20 is at an angle with the first handle part 10, the user may turn an object (such as a screw) with smaller force, as an arm of force is provided.

A receptacle 23 extends in the end face 21 of the second handle part 20. The second handle part 20 further includes a slot 24 that is defined in an outer periphery of the second handle part 20 and that is in communication with the receptacle 23.

The positioning member 30 is slidably received in the receptacle 23 of the second handle part 20. The positioning member 30 includes an end 301 extendible into one of the positioning holes 14 of the first handle part 10 for positioning purposes. The end 301 of the positioning member 30 may include a slanted end face. An elastic element 31 is mounted between an end wall defining the receptacle 23 and the other end of the positioning member 30 for biasing the positioning member 30 outward.

The control member 40 is mounted on the second handle part 20 and includes an engaging portion 401 extending through the slot 24 into an engaging hole 302 of the positioning member 30, allowing joint sliding movement of the control member 40 and the positioning member 30. The slot 24 is sufficiently long to allow the engaging portion 40 to move in a longitudinal direction of the second handle part 20.

Referring to FIG. 7, when the second handle part 20 is in the first position (the whole screwdriver handle 1 is in the in-line state), the axes of the first handle part 10 and the second handle part 20 are coincident with each other. Further, the first handle part 10 and the second handle part 20 provide a smooth outer periphery to avoid accumulation of dust. An aesthetically pleasing appearance is provided while allowing comfortable gripping as well as easy application of force. It is noted that an end of the positioning member 30 is biased by the elastic element 31 into one of the positioning holes 14 of the first handle part 10 to provide a reliable positioning effect for the first and second handle parts 10 and 20.

Figure 8:
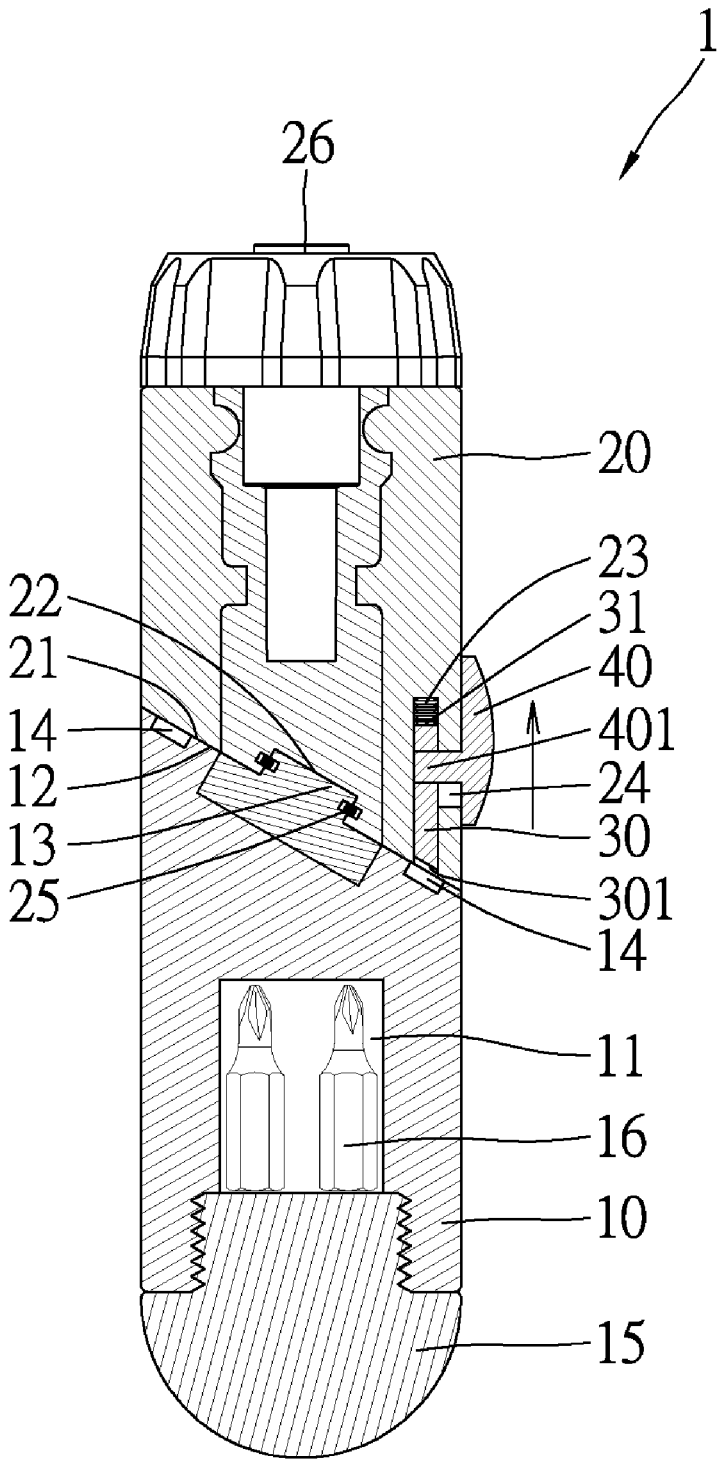
FIG. 8 is a view similar to FIG. 7, illustrating adjustment of the position of a handle part of the screwdriver handle in FIG. 5.

Referring to FIG. 8, when the control member 40 is moved away from the first handle part 10, the end of the positioning member 30 is disengaged from the positioning hole 14 and compresses the elastic element 31. In this case, the second handle part 20 is released from the first handle part 10.

The second handle part 20 can be pivoted 180 degrees relative to the first handle part 10 to an angled state shown in FIGS. 9 and 10. The other positioning hole 14 of the first handle part 10 is now aligned with the receptacle 23 of the second handle part 20, and the positioning member 30 is biased by the elastic element 31 into the positioning hole 14 of the first handle part 10. The screwdriver handle 1 in this state provides an arm of force to allow the user to turn a screw or the like with smaller force. Further, the screwdriver handle 1 has a smaller size and thus can be used in a smaller space.

Since the connecting portion 10*a* of the first handle part 10 and the connecting portion 20*a* of the second handle part 20 are symmetric and non-circular, a smooth outer appearance is obtained even though the screwdriver handle 1 is in the angled state. Accumulation of dust is avoided while allowing comfortable gripping as well as easy application of force.

Figure 11:
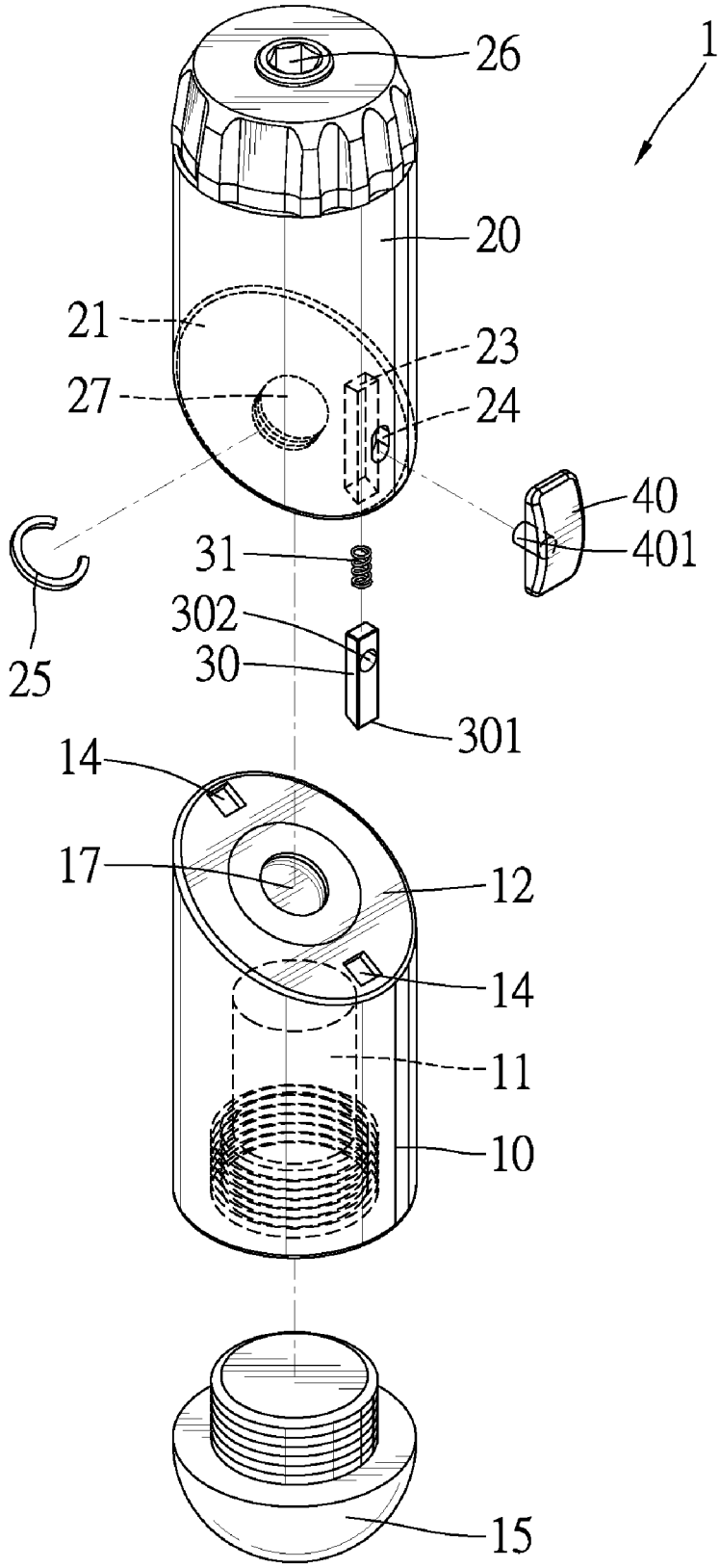
FIG. 11 is an exploded perspective view of a modified embodiment of the screwdriver handle in accordance with the present invention.
Figure 12:
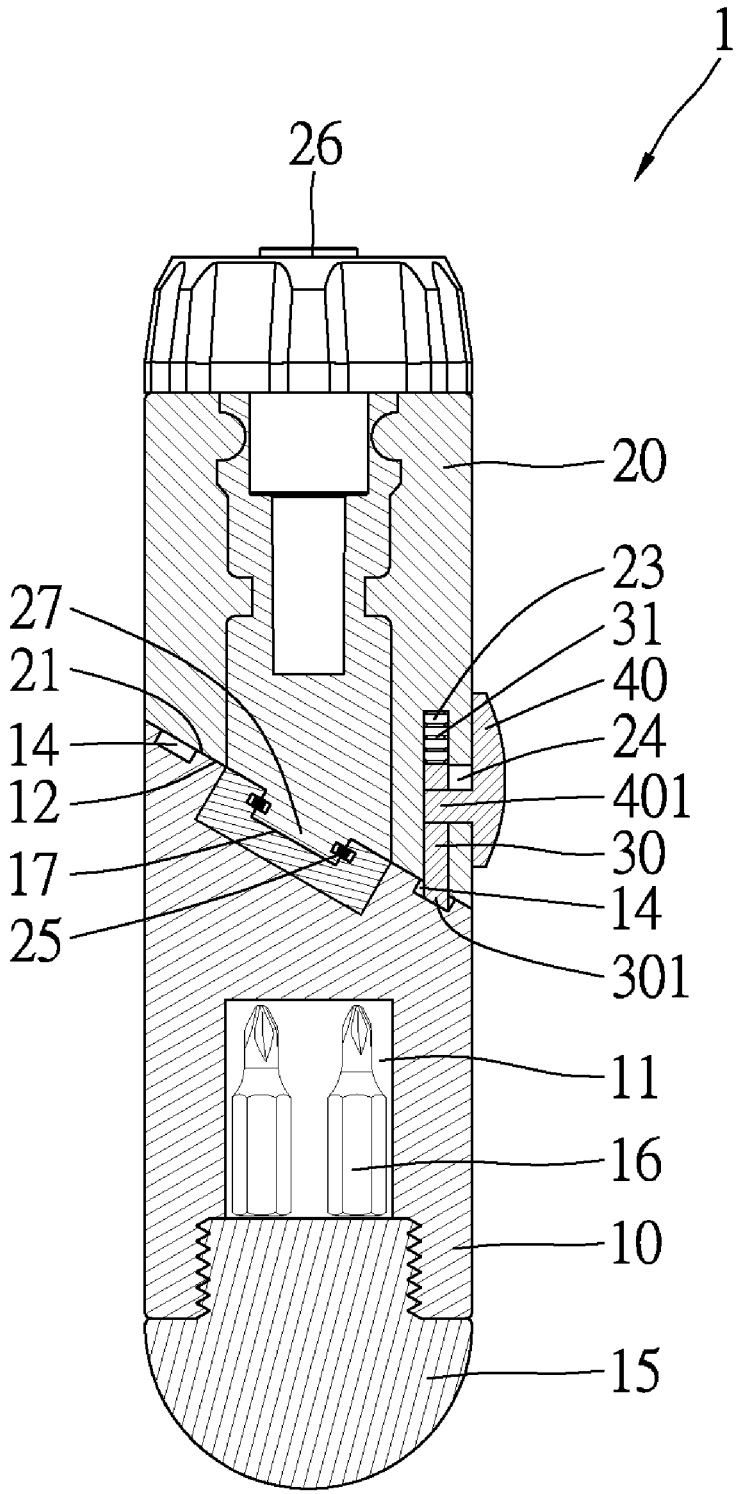
FIG. 12 is a sectional view of the screwdriver handle in FIG. 11.
Figure 13:
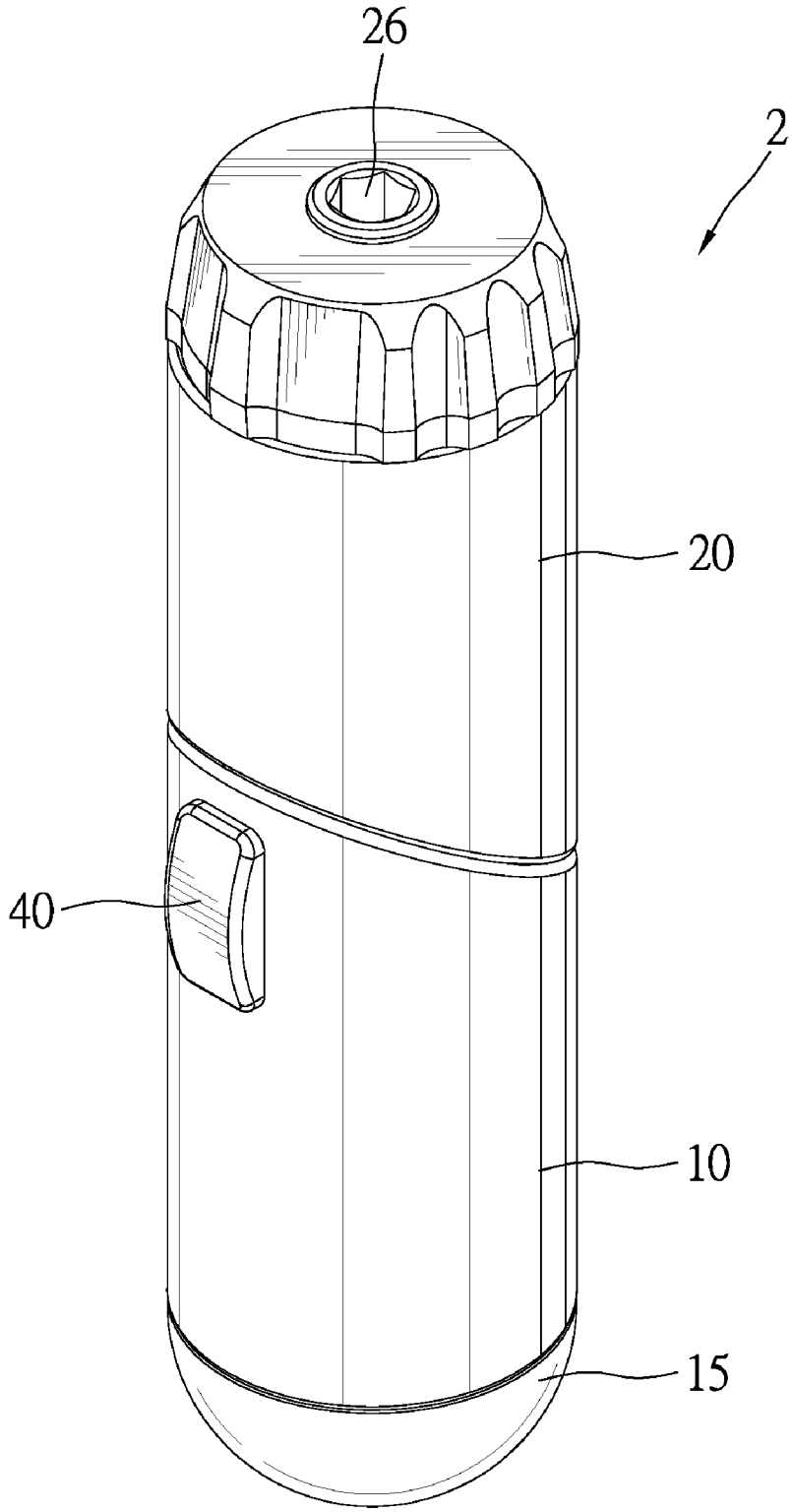
FIG. 13 is a perspective view of another modified embodiment of the screwdriver handle in accordance with the present invention.
Figure 14:
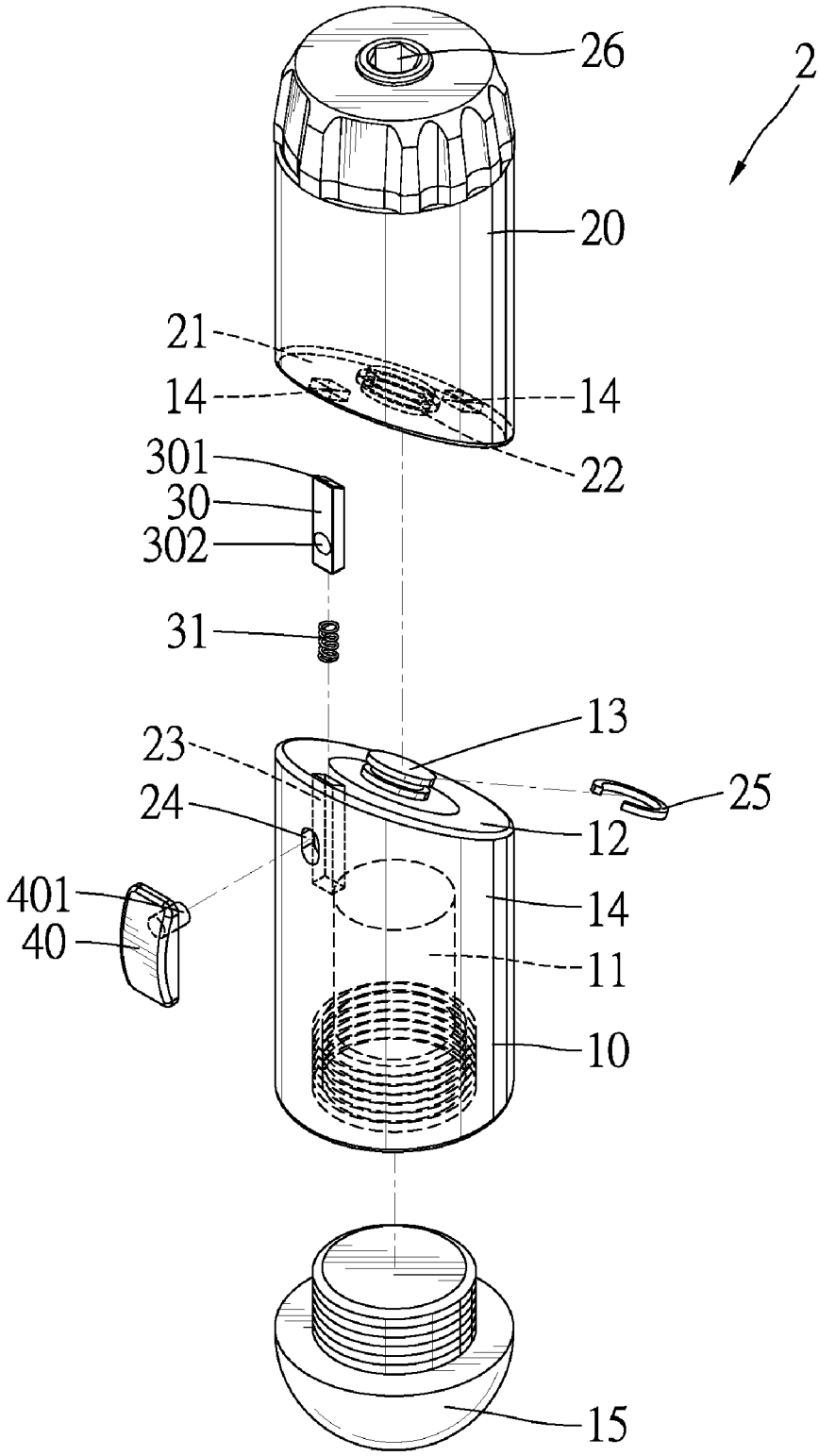
FIG. 14 is an exploded perspective view of the screwdriver handle in FIG. 13.
Figure 15:
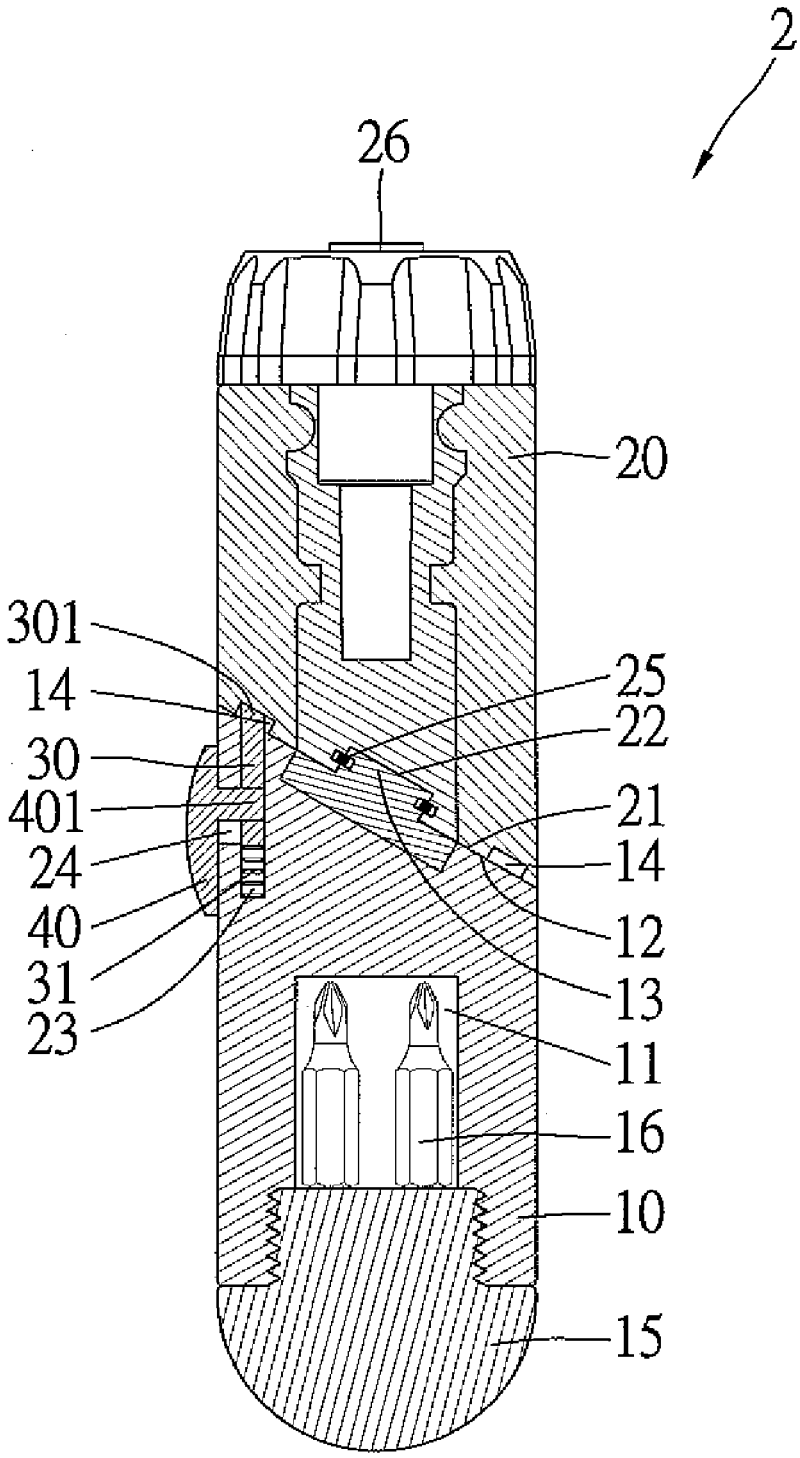
FIG. 15 is a sectional view of the screwdriver handle in FIG. 13.
Figure 16:
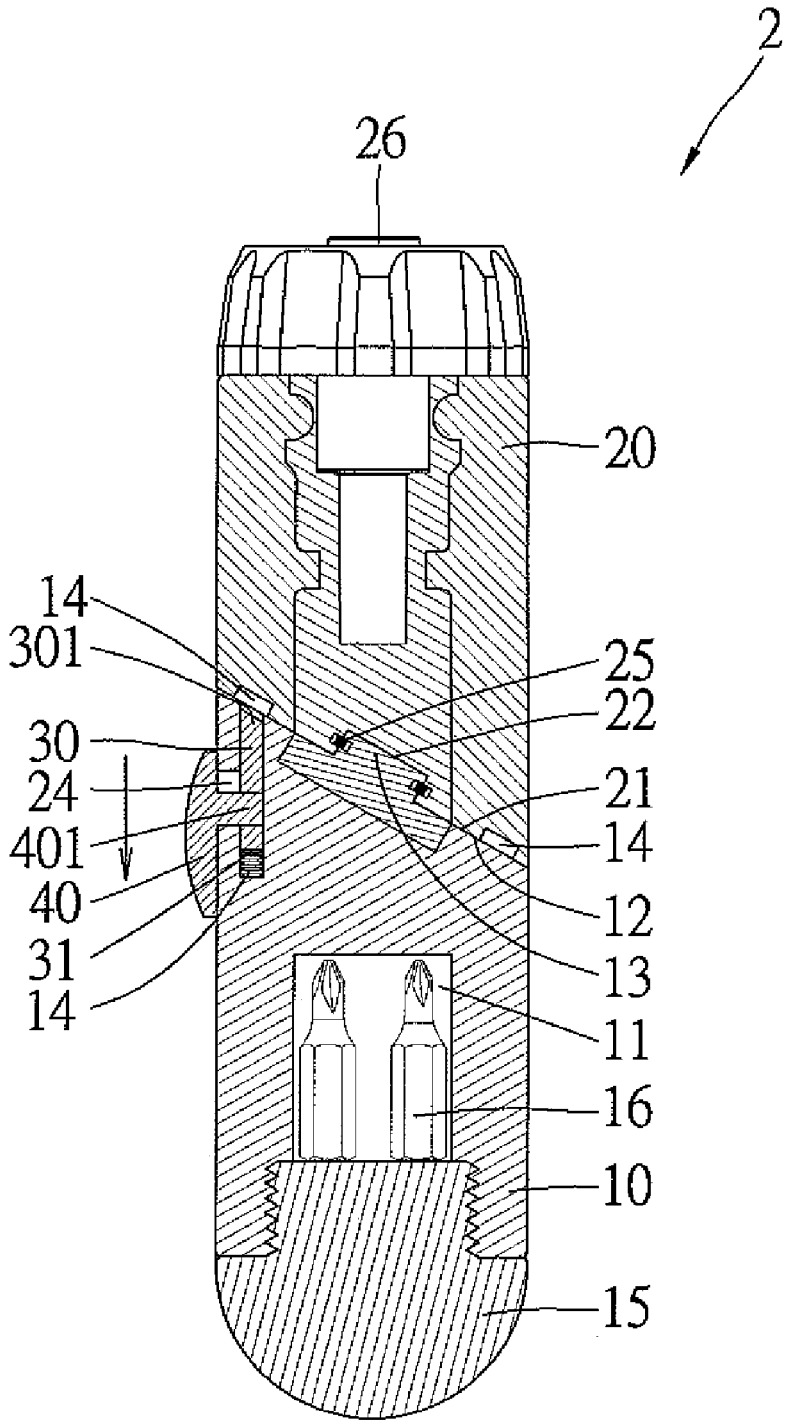
FIG. 16 is a view similar to FIG. 15, illustrating adjustment of the position of the handle part of the screwdriver handle.
Figure 17:
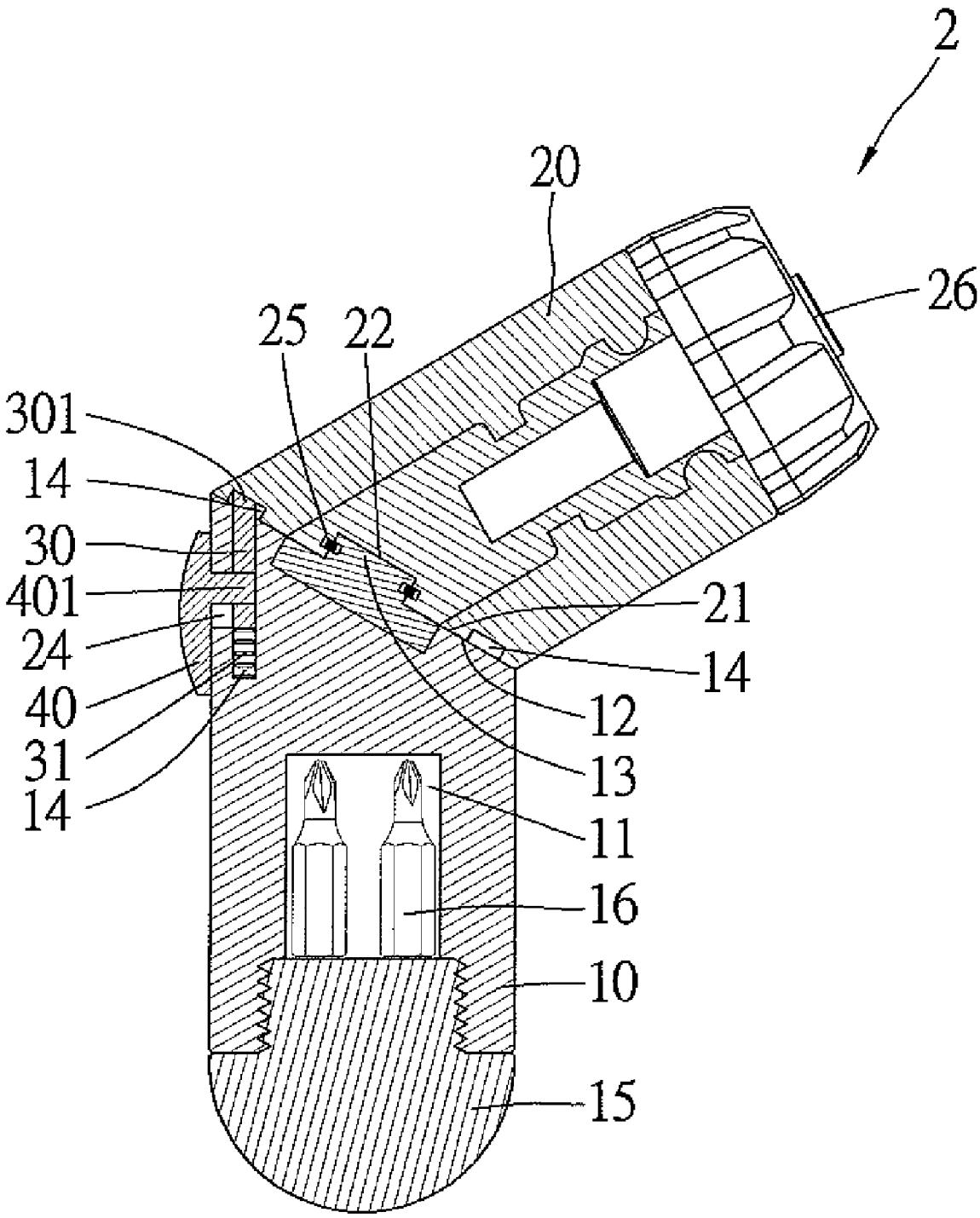
FIG. 17 is a sectional view of the screwdriver handle in FIG. 16 in an angled state.
Figure 18:
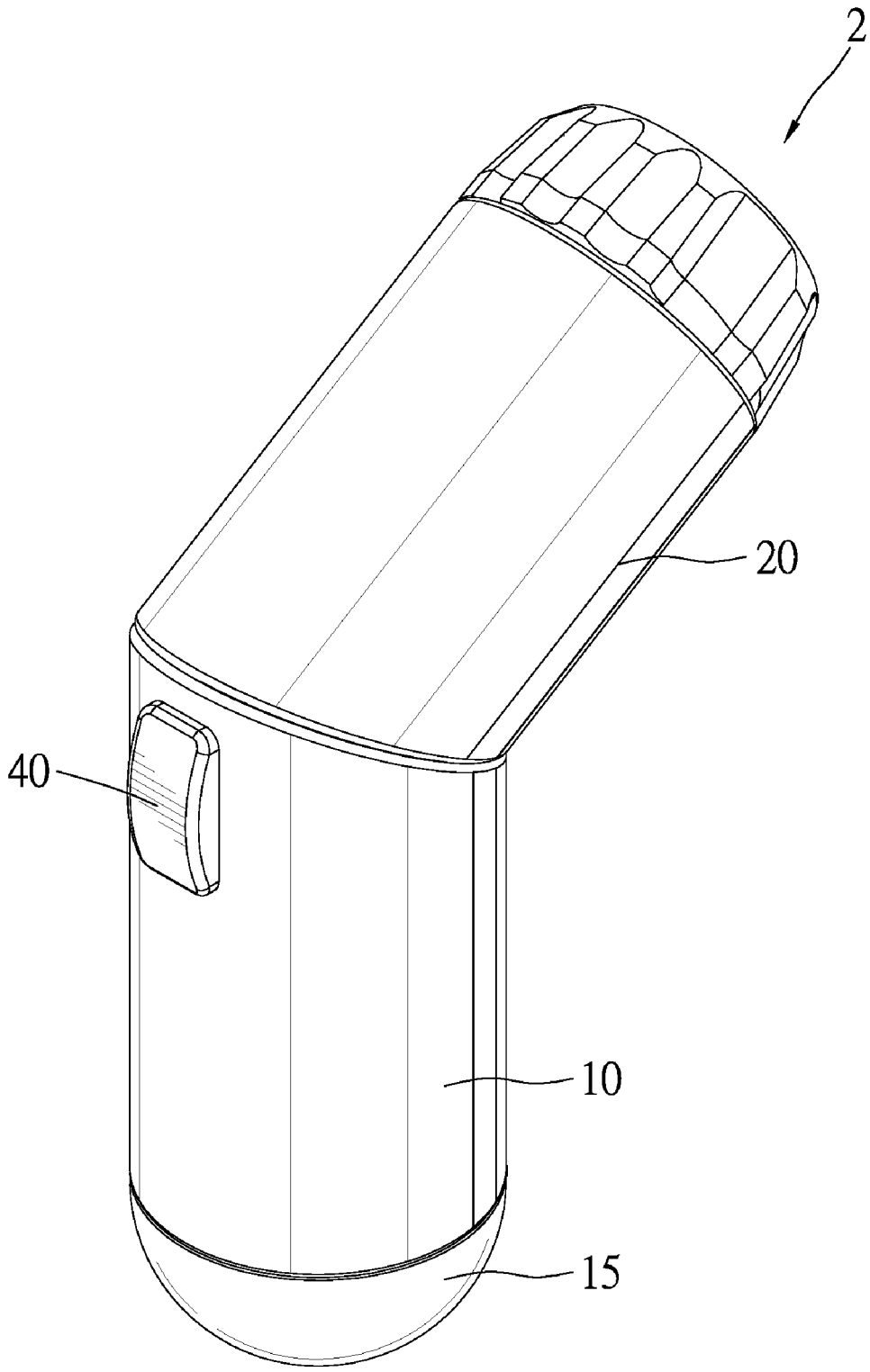
FIG. 18 is a perspective view of the screwdriver handle in FIG. 17.

FIGS. 11 and 12 illustrate a modified embodiment modified from the screwdriver handle 1 of FIGS. 1-10. In this embodiment, the pivotal coupling portion of the first handle part 10 is a cylindrical groove 17 whereas the pivotal coupling portion of the second handle part 20 is a cylindrical axle 27 pivotably received in the cylindrical groove 17.

FIGS. 13 through 17 illustrate another modified embodiment modified from the embodiment of FIGS. 1 through 10. In this embodiment, the receptacle 23, the slot 24, the control member 40, the positioning member 30, and the elastic element 31 are provided on the first handle part 10 whereas the positioning holes 14 are defined in the second handle part 20.

Figure 19:
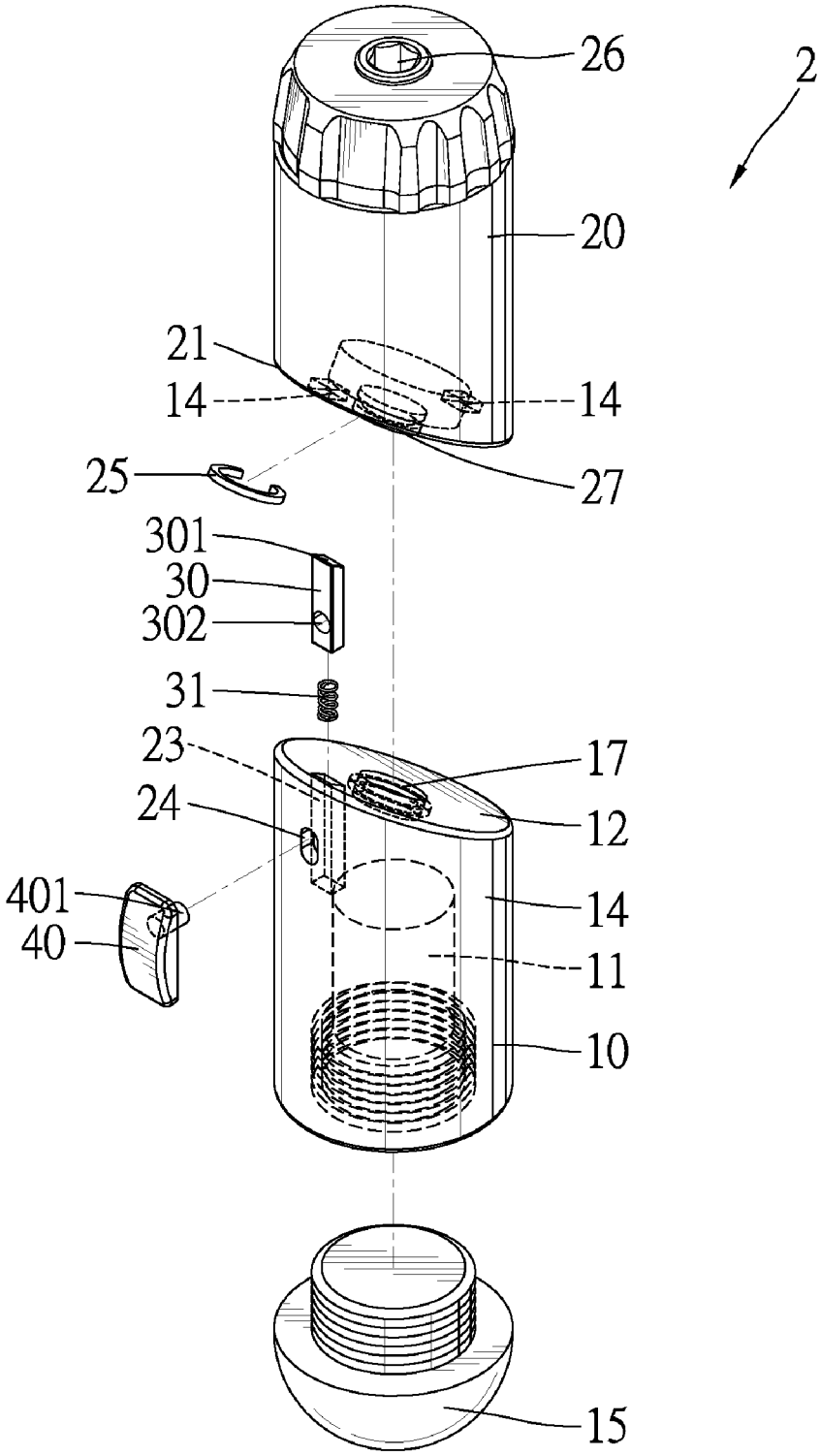
FIG. 19 is an exploded perspective view of a further modified embodiment of the screwdriver handle in accordance with the present invention.
Figure 20:
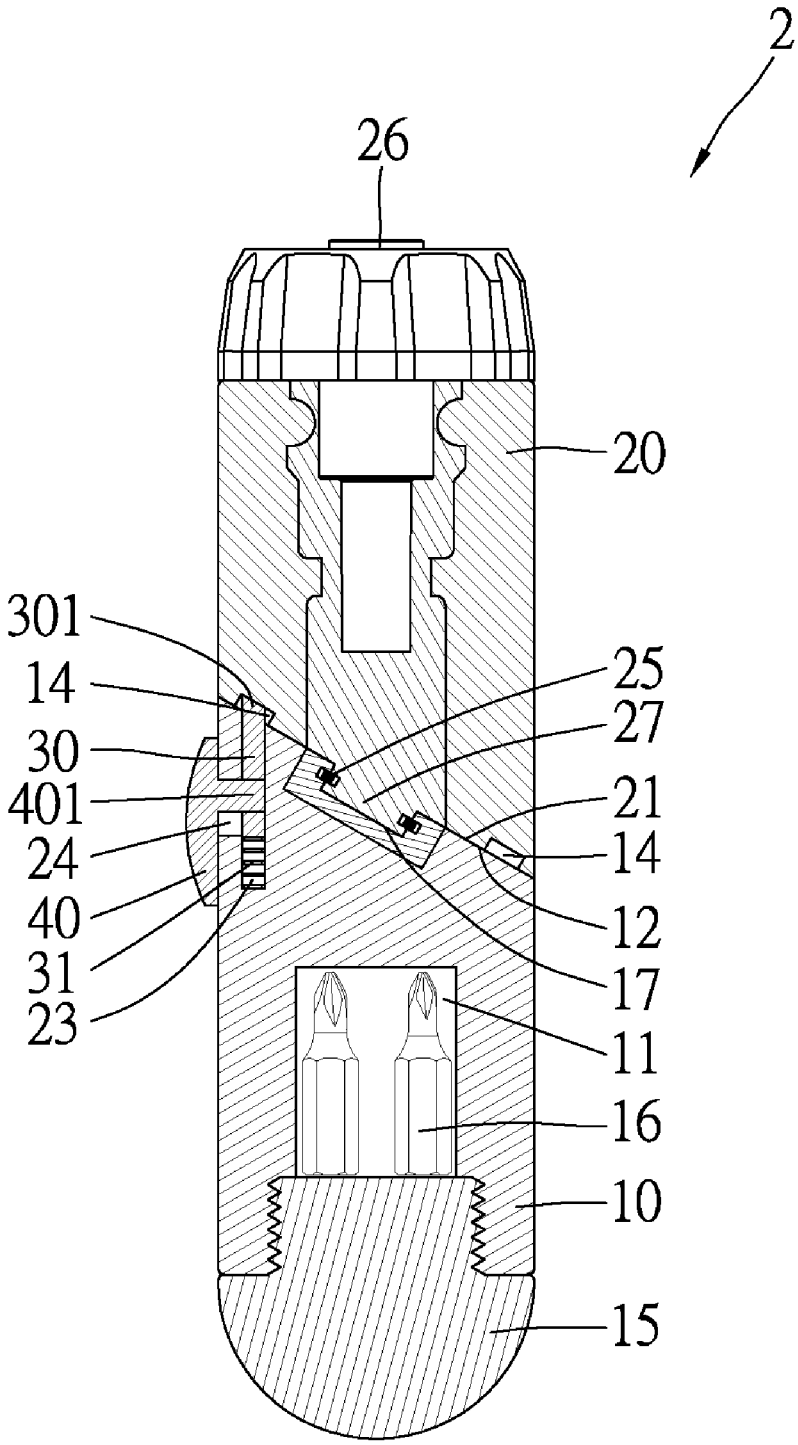
FIG. 20 is a sectional view of the screwdriver handle in FIG. 19.

FIGS. 19 and 20 illustrate a further modified embodiment modified from the screwdriver handle 2 of FIGS. 12-18. In this embodiment, the pivotal coupling portion of the first handle part 10 is a cylindrical groove 17 whereas the pivotal coupling portion of the second handle part 20 is a cylindrical axle 27 pivotally received in the cylindrical groove 17.

In conclusion, the screwdriver handle 1 in accordance with the present invention has a smaller length while allowing the handle to be switched between an in-line state and an angled operating state. Further, the user's hand will not be pinched even though the screwdriver handle is in the angled state. Further, the screwdriver handle has a smooth outer periphery to allow comfortable gripping while providing an aesthetically pleasing appearance and preventing accumulation of dust. Further, only one receptacle 23 is required for the screwdriver handle 1 of the type allowing switching between an in-line state and an angled state. The manufacturing cost is low and the assembling procedure is simple. Further, the oval end faces 12 and 21 of the first and second handle parts 10 and 20 a larger torque-bearing capacity for the screwdriver handle. Further, the control member 40 can be operated in the same direction regardless of the state of the screwdriver handle 1 while providing a simple structure.

Although specific embodiments have been illustrated and described, numerous modifications and variations are still possible without departing from the essence of the invention. The scope of the invention is limited by the accompanying claims.

What is claimed is:

1. A screwdriver handle comprising:

a first handle part including a first end face;

a second handle part including a second end face;

a first pivotal coupling portion being formed on the first end face of the first handle part, with the first pivotal coupling portion having an axle including a first circumferential wall extending away from the first end face, with the first circumferential wall having a first annular groove spaced from and parallel to the first end face, with the first annular groove defining a first annular groove diameter extending parallel to the first end face of the first handle part, with the first circumferential wall defining a first circumferential wall diameter extending parallel to the first annular groove diameter, with the first annular groove diameter being smaller than the first circumferential wall diameter;

a second pivotal coupling portion being formed on the second end face of the second handle part, with the second pivotal coupling portion having a second circumferential wall pivotally engaged with the first circumferential wall of the first pivotal coupling portion, with the second circumferential wall defining an axle receiving groove and having a second annular groove spaced from and parallel to the second end face, with the second annular groove defining a second annular groove diameter extending parallel to the second end face, with the second circumferential wall having a second circumferential wall diameter extending parallel to the second annular groove diameter, with the second circumferential wall diameter being smaller than the second annular groove diameter;

a retainer ring simultaneously received in both the first and second annular grooves of the first and second circumferential walls when the first and second pivotal coupling portions are engaged retaining the first pivotal coupling portion to the second pivotal coupling portion, with the retainer ring being deformable in one of the first and second annular grooves when the first coupling portion is inserted into the second coupling portion, with the second handle part being pivotable between a first position and a second position relative to the first handle part, with the screwdriver handle switchable between an in-line state and an angled state;

two positioning holes being defined in one of the first and second end faces of the first and second handle parts;

a receptacle being defined in another one of the first and second end faces of the first and second handle parts, the receptacle being aligned with one of the two positioning holes when the screwdriver handle is in the in-line state and the angled state;

a positioning member being mounted in the receptacle and including an end releasably engaged with the one of the two positioning holes to retain the second handle part in one of the first position and the second position, with the end of the positioning member being biased to engage with the one of the two positioning holes; and a control member being mounted on one of the first and second handle parts and connected to the positioning member, the control member being operable to disengage the end of the positioning member from the one of the two positioning holes to allow the second handle part to pivot relative to the first handle part.

2. The screwdriver handle as claimed in claim 1 wherein the first and second end faces of the first and second handle parts are slanted.

3. The screwdriver handle as claimed in claim 2 wherein the first and second end faces of the first and second handle parts are oval.

4. The screwdriver handle as claimed in claim 1 wherein the positioning holes are located on a longitudinal axis of the second end face of the second handle part.

5. The screwdriver handle as claimed in claim 1 wherein said one of the first and second handle parts on which the control member is mounted includes a slot in communication with the receptacle, wherein the control member includes an engaging portion extending through the slot to securely engage with the positioning member.

* * * * *